US008481239B2

(12) United States Patent
Nakajima et al.

(10) Patent No.: US 8,481,239 B2
(45) **Date of Patent: *Jul. 9, 2013**

(54) CARRIER FOR TWO-COMPONENT DEVELOPER

(75) Inventors: Hisashi Nakajima, Numazu (JP); Kimitoshi Yamaguchi, Numazu (JP); Minoru Masuda, Numazu (JP); Yutaka Takahashi, Yokohama (JP); Koichi Sakata, Shizuoka-ken (JP); Hitoshi Iwatsuki, Numazu (JP); Saori Yamada, Numazu (JP); Toyoaki Tano, Numazu (JP)

(73) Assignee: Ricoh Company Limited, Tokyo (JP)

( * ) Notice: Subject to any disclaimer, the term of this patent is extended or adjusted under 35 U.S.C. 154(b) by 236 days.

This patent is subject to a terminal disclaimer.

(21) Appl. No.: 12/896,276

(22) Filed: Oct. 1, 2010

(65) Prior Publication Data

US 2011/0086307 A1 Apr. 14, 2011

(30) Foreign Application Priority Data

| | | |
|---|---|---|
| Oct. 13, 2009 | (JP) | 2009-236349 |
| Oct. 15, 2009 | (JP) | 2009-238554 |
| Dec. 17, 2009 | (JP) | 2009-286748 |
| Aug. 3, 2010 | (JP) | 2010-174106 |
| Sep. 6, 2010 | (JP) | 2010-199278 |

(51) Int. Cl.
*G03G 9/00* (2006.01)

(52) U.S. Cl.
USPC ..... 430/111.35; 430/111.1; 430/111.3; 430/111.31; 430/123.4

(58) Field of Classification Search
USPC ..... 430/111.1, 111.3, 111.31, 111.35, 430/123.4
See application file for complete search history.

(56) References Cited

U.S. PATENT DOCUMENTS 5,652,079 A * 7/1997 Mochizuki et al. ..... 430/111.1
8,211,610 B2 * 7/2012 Yamaguchi et al. ..... 430/111.35

(Continued)

FOREIGN PATENT DOCUMENTS

CN 101351747 A 1/2009
JP 55-127569 10/1980

(Continued)

OTHER PUBLICATIONS

Office Action issued Oct. 15, 2012 in Chinese Patent Application No. 201010510269.6.

(Continued)

*Primary Examiner* — Mark F Huff
*Assistant Examiner* — Stewart Fraser
(74) *Attorney, Agent, or Firm* — Oblon, Spivak, McClelland, Maier & Neustadt, L.L.P.

(57) ABSTRACT

A carrier, including a magnetic particulate core material and a resin layer on the core material, wherein the resin layer includes a resin obtained by heat treatment of a copolymer including a site derived from a monomer component having the following formula (1) and a site derived from a monomer component having the following formula (2), and includes a cross-linked material obtained by hydrolysis of the copolymer to produce a silanol group and condensation using an organotitanium compound:

(1)

(2)

wherein $R^1$ represents a hydrogen atom or a methyl group; m represents an alkylene group having 1 to 8 carbon atoms; $R^2$ represents an alkyl group having 1 to 4 carbon atoms; $R^3$ represents an alkyl group having 1 to 8 carbon atoms, or an alkoxy group having 1 to 4 carbon atoms; X represents 10 to 90 mol %; and Y represents 10 to 90 mol %.

18 Claims, 1 Drawing Sheet

U.S. PATENT DOCUMENTS

| | | | | |
|---|---|---|---|---|
| 2008/0096121 | A1 | 4/2008 | Iwatsuki et al. | |
| 2008/0152393 | A1 | 6/2008 | Nagayama et al. | |
| 2008/0213684 | A1 | 9/2008 | Nagayama et al. | |
| 2008/0227004 | A1 | 9/2008 | Yamaguchi et al. | |
| 2009/0041510 | A1 | 2/2009 | Imahashi et al. | |
| 2010/0239975 | A1 | 2/2009 | Yamaguchi et al. | |
| 2009/0092920 | A1 | 4/2009 | Nagayama et al. | |
| 2010/0233613 | A1 | 9/2010 | Masuda et al. | |
| 2011/0091802 | A1* | 4/2011 | Takahashi et al. | 430/108.3 |

FOREIGN PATENT DOCUMENTS

| | | |
|---|---|---|
| JP | 55-157751 | 12/1980 |
| JP | 56-140358 | 11/1981 |
| JP | 57-96355 | 6/1982 |
| JP | 57-96356 | 6/1982 |
| JP | 58-207054 | 12/1983 |
| JP | 61-110161 | 5/1986 |
| JP | 62-273576 | 11/1987 |
| JP | 6-222621 | 8/1994 |
| JP | 2001-92189 | 4/2001 |
| JP | 2003-345070 | 12/2003 |
| JP | 2006-337828 | 12/2006 |

OTHER PUBLICATIONS

U.S. Appl. No. 12/897,326, filed Oct. 4, 2010, Takahashi, et al.

* cited by examiner

CARRIER FOR TWO-COMPONENT DEVELOPER

BACKGROUND OF THE INVENTION

1. Field of the Invention

The present invention relates to a carrier formed of a coated particulate core material and a method of preparing the carrier, and to a developer, a container containing the developer, an image forming method and a process cartridge.

2. Description of the Related Art

Electrophotographic image forming methods include forming an electrostatic latent image on an image bearer such as a photoconductive material, transferring a charged toner thereto to form a visible image (toner image), transferring the toner image onto a recording medium such as paper, and fixing the toner image thereon to form a final output image. Recently, electrophotographic copiers and printers are rapidly developing from monochrome to full-color, and full-color markets are expanding.

The electrophotographic image forming methods typically include overlaying three primary color toners, i.e., yellow, magenta, and cyan toners, or four color toners including the previous three and black toner, to reproduce all colors. Therefore, to produce a sharp full-color image having good color reproducibility, the surface of a fixed toner image has to be smooth to reduce light scattering. This is why many conventional full-color copiers produce images having medium to high glossiness of from 10 to 50%.

As a method of fixing a dry toner image on a recording medium, contact heat fixing methods using a heated roller or a heated belt having a smooth surface are typically used. Although the methods have high heat efficiency and are capable of fixing at high speed and imparting gloss and transparency to color toners, offset problems do occur, wherein a part of a toner image adheres to a fixing member and transfers to another image occur during separation of the fixing member from the melted toner image after pressing the surface of the fixing member.

For the purpose of preventing offset problems, the surface of the fixing member has typically been coated with silicone rubber or a fluorine-containing resin. Further, a releasing agent in the form of an oil such as silicone oil is applied to the surface of the fixing member. Although this approach is quite effectively used to prevent offset problems, a release oil applicator is required and the resultant fixer becomes larger.

Therefore, as an alternative, there are oilless arrangements using a monochrome toner having high viscoelasticity when melted so as not to breakdown internally, wherein the molecular weight distribution of a binder resin of the toner is controlled, and further including a release agent such as wax, or systems that apply only a small amount of oil.

In addition, even full-color image forming apparatuses are becoming oilless as well for the purpose of being downsized and simplified. However, as mentioned above, to improve color reproducibility of a color toner, the color toner needs to have lower viscoelasticity because the fixed color toner image is required to have a smooth surface. Therefore, the color toner has offset problems more often than the monochrome toner does, making it more difficult to make a fixer oilless or use only a small amount of oil. In addition, a toner including a release agent has higher adherence to an image bearer and lower transferability to a transfer paper. Further, the release agent therein contaminates friction-charged members such as a carrier and lowers the chargeability thereof, resulting in deterioration of durability of the toner.

On the other hand, for the purpose of preventing toner constituents from filming, making the surface thereof uniform, preventing oxidization thereof, preventing deterioration of moisture sensitivity thereof, extending lives of developers, preventing adherence of the carriers to the surfaces of photoreceptors, protecting photoreceptors from being damaged or abraded by the carriers, controlling charge polarity thereof and controlling charge quantity thereof, a resin having a low surface energy such as fluorine-containing resins and silicone resins is applied on the carrier core material to prolong the life of the carrier.

As examples of carriers coated with a resin having a low surface energy, Japanese published unexamined application No. 55-127569 discloses a carrier coated with an ordinary-temperature curing silicone resin and a positively-chargeable nitrogen resin, Japanese published unexamined application No. 55-157751 discloses a carrier coated with a coated material including at least one modified silicone resin, Japanese published unexamined application No. 56-140358 discloses a carrier having a coated layer including an ordinary-temperature curing silicone resin and a styrene acrylic resin, Japanese published unexamined application No. 57-96355 discloses a carrier coated with two or more silicone resin layers having no adherence to each other, Japanese published unexamined application No. 57-96356 discloses a carrier coated with silicone resin multiple layers, Japanese published unexamined application No. 58-207054 discloses a carrier coated with a silicone resin including a silicon carbonate, Japanese published unexamined application No. 61-110161 discloses a positively-chargeable carrier coated with a material having a critical surface tension not greater than 20 dyn/cm, and Japanese published unexamined application No. 62-273576 discloses a developer formed of a carrier coated with a material including fluorine-containing alkylacrylate and a toner including a chrome azo dye.

It is known that a coating liquid including a siloxane material having a condensation reactable silanol group or its precursors (hydrolysis groups such as halo(silyl) groups and alkoxy silyl groups) is condensed to a polysiloxane material with titanium catalysts to coat the surface of a carrier particulate core material. Japanese published unexamined application No. 2001-92189 discloses coating a particulate core material with a silicone resin including organic titanium catalysts, and discloses diisopropoxybis(acetylacetonate) disclosed in Comparative Example 2, tetraisopropoxytitanium disclosed in Comparative Example 1, isopropoxy(2-ethylhexanediolato)titanium, bis(acryloyloxy)isopropoxyisostearoyloxytitanium, bis(2,4-pentadionate) and (1,3-propanedionate)titanium as titanium catalysts. Japanese published unexamined application No. 06-222621 discloses coating the surface of a particulate core material with a composition formed of at least one curing catalyst selected from a group consisting of organopolysiloxane, organosilane, titanium such as tetraisopropoxytitanium, tin such as dibutyltindiacetate, zinc, cobalt, iron, aluminum compounds and amines. Further, Japanese published unexamined application No. 2006-337828 discloses a particulate core material that is coated with a silicone resin or a modified silicone resin including a quaternary ammonium salt catalyst, aluminum catalyst or a titanium catalyst such as disopropoxybis(acetylacetonate).

However, particulate toner has a smaller particle diameter to produce higher-quality images. Further, printing speed is constantly increasing, and therefore a phenomenon known as toner spent on carrier more easily occurs. A developer including a wax for easy maintenance sharply increases toner spent, resulting in lowering the toner charge, toner scattering, and background fouling.

In full-color electrophotographic systems, when toner spent on carrier occurs, coated layer thereof is damaged or peeled off, the carrier resistance and the developer consumption varies, and the image density, particularly the image density of a highlighted part, varies. Further, escaped filler due to the damaged coated layer contaminates the color of a toner (particularly a yellow toner), and high quality images are not reliably produced.

In addition, blocking occurs when forming a coated layer, and consequently the durability thereof deteriorates.

For these reasons, a need exists for a carrier having good toner spent resistance and abrasion (damage or peeling) resistance of its coated layer.

SUMMARY OF THE INVENTION

Accordingly, an object of the present invention is to provide a carrier having good toner spent resistance and abrasion (damage or peeling) resistance of its coated layer.

Another object of the present invention is to provide a developer including the carrier.

A further object of the present invention is to provide a container containing the developer.

Another object of the present invention is to provide an image forming method using the developer.

A further object of the present invention is to provide a process cartridge using the developer.

These objects and other objects of the present invention, either individually or collectively, have been satisfied by the discovery of a carrier for an electrostatic latent image developer, comprising:

a magnetic particulate core material; and a resin layer overlying the magnetic particulate core material, wherein the resin layer comprises a resin obtained by heat treatment of a copolymer including a site derived from a monomer component having the following formula (1) and a site derived from a monomer component having the following formula (2), and wherein the resin layer comprises a cross-linked material obtained by hydrolysis of the copolymer to produce a silanol group and condensation using an organotitanium compound:

(1)

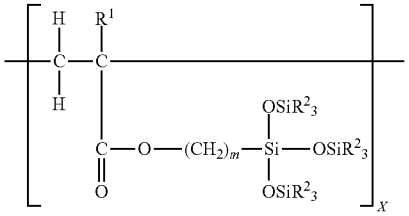

(2)

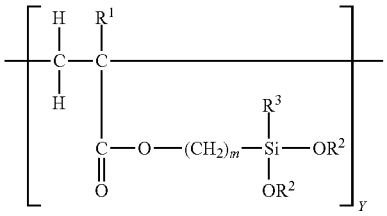

wherein $R^1$ represents a hydrogen atom or a methyl group; m represents an alkylene group having 1 to 8 carbon atoms; $R^2$: represents an alkyl group having 1 to 4 carbon atoms; $R^3$ represents an alkyl group having 1 to 8 carbon atoms, or an alkoxy group having 1 to 4 carbon atoms; X represents 10 to 90 mol %; and Y represents 10 to 90 mol %.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawing(s) in which like reference characters designate like corresponding parts throughout and wherein.

DETAILED DESCRIPTION OF THE INVENTION

Figure 1:
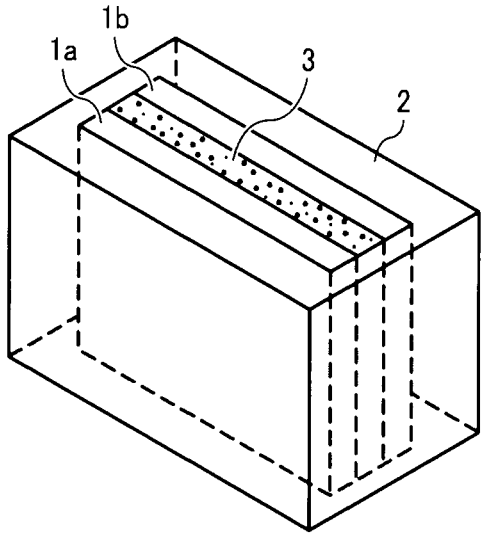
FIG. 1 is a schematic view illustrating a cell for use in measuring a specific volume resistivity of a carrier of the present invention.

The present invention provides a carrier having good toner spent resistance and abrasion (damage or peeling) resistance of its coated layer. More particularly, the present invention relates to a carrier for an electrostatic latent image developer, comprising:

a magnetic particulate core material; and a resin layer overlying the magnetic particulate core material, wherein the resin layer comprises a resin obtained by heat treatment of a copolymer including a site derived from a monomer component having the following formula (1) and a site derived from a monomer component having the following formula (2), and wherein the resin layer comprises a cross-linked material obtained by hydrolysis of the copolymer to produce a silanol group and condensation using an organotitanium compound:

(1)

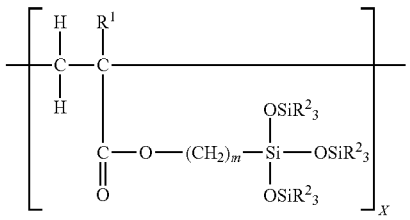

(2)

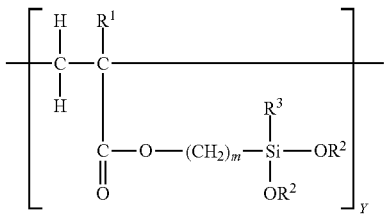

wherein $R^1$ represents a hydrogen atom or a methyl group; m represents an alkylene group having 1 to 8 carbon atoms; $R^2$: represents an alkyl group having 1 to 4 carbon atoms; $R^3$ represents an alkyl group having 1 to 8 carbon atoms, or an alkoxy group having 1 to 4 carbon atoms; X represents 10 to 90 mol %; and Y represents 10 to 90 mol %.

Next, a mode for carrying out the present invention is detailed together with the drawings.

The carrier for an electrostatic latent image developer of the present invention, which is composed of a magnetic particulate core material and a resin layer coating its surface, being composed of a magnetic particulate core material and a coating layer covering the surface of said particulate core material, characterized in that the coating layer contains a cross-linked material obtained by hydrolysis of a copolymer expressed by the following general formulas (3), (5) to produce a silanol group, and condensation using an organotitanium catalyst.

Namely, the carrier of the present invention is an carrier for an electrostatic latent image developer obtained in such manner that a binary acrylic copolymer (copolymer of the following general formula (3)) obtained by radical copolymerization of the monomer A component and monomer B component described below (in this regard, expressed by a site derived from each component to facilitate understanding of amount ratio etc.), or a ternary acrylic copolymer (copolymer of the general formula (5)) obtained by radical copolymerization of the monomer A component, monomer B component and monomer C component (the following general formula (4)) is hydrolyzed to produce a silanol group, which is cross-linked by condensation using an organotitanium catalyst and coated, followed by heat treatment.

(1)

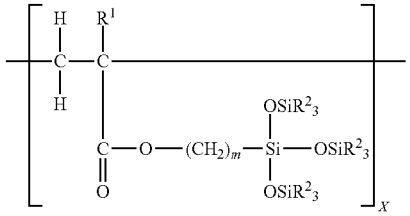

In the formula of the A component, $R^1$: a hydrogen atom or a methyl group m: an alkylene group having 1 to 8 carbon atoms such as methylene group, ethylene group, propylene group and butylene group $R^2$: an aliphatic hydrocarbon group having 1 to 4 carbon atoms; methyl group, ethyl group, propyl group and butyl group In A component, X is 10 to 90 mol %, and more preferably, 30 to 70 mol %.

The A component has tris(trimethylsiloxy)silane of an atomic group with a lot of methyl groups in the side chain, when the ratio of A component increases in the whole resin, a surface energy becomes small, and adhesion of the resin component of toner, wax component etc. becomes small. When the A component is less than 10 mol %, a sufficient effect cannot be obtained and adhesion of toner component increases at a great rate. When more than 90 mol %, the (3)

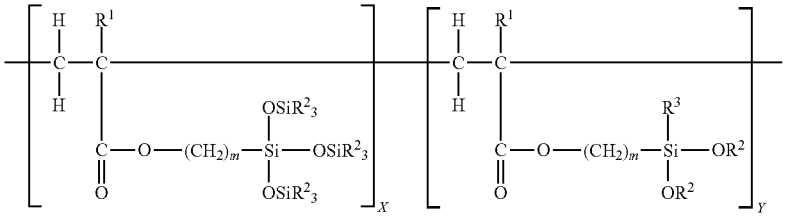

(5)

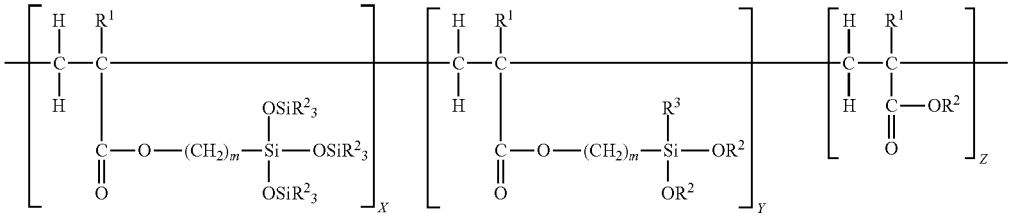

In the formulas, $R^1$, m, $R^2$, $R^3$, X, Y and Z represent the followings.

$R^1$: a hydrogen atom or a methyl group m: an alkylene group having 1 to 8 carbon atoms such as methylene group, ethylene group, propylene group and butylene group $R^2$: an alkyl group having 1 to 4 carbon atoms such as methyl group, ethyl group, propyl group, isopropyl group and butyl group $R^3$: an alkyl group having 1 to 8 carbon atoms such as methyl group, ethyl group, propyl group, isopropyl group and butyl group, or an alkoxy group having 1 to 4 carbon atoms such as methoxy group, ethoxy group, propoxy group and butoxy group component B and component C decrease, crosslink does not proceeds, along with lack of toughness, adhesiveness between core material and resin layer lowers and durability of carrier coating becomes bad.

$R^2$ is an alkyl group having 1 to 4 carbon atoms, as such monomer component, it is exemplified by tris(trialkylsiloxy) silane compound shown in the following formula.

In the formula, Me is a methyl group, Et is an ethyl group and Pr is a propyl group.

$CH_2{=}CMe\text{-}COO{-}C_3H_6{-}Si(OSiMe_3)_3$ $CH_2{=}CH{-}COO{-}C_3H_6{-}Si(OSiMe_3)_3$ $CH_2{=}CMe\text{-}COO{-}C_4H_8{-}Si(OSiMe_3)_3$ $CH_2{=}CMe\text{-}COO{-}C_3H_6{-}Si(OSiEt_3)_3$ $CH_2{=}CH{-}COO{-}C_3H_6{-}Si(OSiEt_3)_3$ $CH_2{=}CMe\text{-}COO{-}C_4H_8{-}Si(OSiEt_3)_3$ $CH_2{=}CMe\text{-}COO{-}C_3H_6{-}Si(OSiPr_3)_3$ $CH_2{=}CH{-}COO{-}C_3H_6{-}Si(OSiPr_3)_3$ $CH_2{=}CMe\text{-}COO{-}C_4H_8{-}Si(OSiPr_3)_3$ The production method of A component is not particularly restricted, this is obtained by a method of reacting tris(trialkylsiloxy)silane with allyl acrylate or allyl methacrylate in the presence of a platinum catalyst, or a method of reacting methacryloxyalkyltrialkoxysilane with hexaalkyldisiloxane in the presence of carboxylic acid and acid catalyst described in Japanese Unexamined Patent Publication No. 11-217389.

(2)

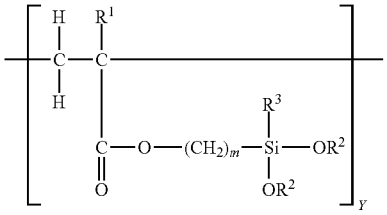

In the formula of the B component, representing $R^1$: a hydrogen atom or a methyl group, m: an alkylene group having 1 to 8 carbon atoms such as methylene group, ethylene group, propylene group and butylene group, $R^2$: an aliphatic hydrocarbon group having 1 to 4 carbon atoms; methyl group, ethyl group, propyl group and butyl group, $R^3$: an alkyl group having 1 to 8 carbon atoms (methyl group, ethyl group, propyl group, butyl group, etc.), or an alkoxy group having 1 to 4 carbon toms (methoxy group, ethoxy group, propoxy group, butoxy group).

Namely, the B component is a radical-polymerizable difunctional or trifunctional silane compound, and Y is 10 to 90 mol %, more preferably 30 to 70 mol %.

When the B component is less than 10 mol %, toughness is not sufficiently obtained. On the other hand, when more than 90 mol %, coating becomes stiff and brittle, and film scraping tends to occur. Environmental characteristics deteriorate as well. A lot of cross-linking components hydrolyzed remain as a silanol group, which is thought to deteriorate an environmental characteristic (humidity dependence).

As such B component, it is exemplified by 3-methacryloxypropyltrimethoxysilane, 3-acryloxypropyltrimethoxysilane, 3-methacryloxypropyltriethoxysilane, 3-acryloxypropyltriethoxysilane, 3-methacryloxypropylmethyldimethoxysilane, 3-methacryloxypropylmethyldiethoxysilane, 3-methacryloxypropyltri(isopropoxy)silane and 3-acryloxypropyltri(isopropoxy)silan.

In the case of the above-described tertiary acrylic copolymer, in addition to the foregoing A component and B component, further, the following C component is copolymerized to be a copolymer expressed by the following general formula (3), and this is hydrolyzed.

As the C component, acrylate and methacrylate are preferable, specifically it is exemplified by methyl methacrylate, methyl acrylate, ethyl methacrylate, ethyl acrylate, butyl methacrylate, butyl acrylate, 2-(dimethylamino)ethyl methacrylate, 2-(dimethylamino)ethyl acrylate, 3-(dimethylamino)propyl methacrylate, 3-(dimethylamino)propyl acrylate, 2-(diethylamino)ethyl methacrylate and 2-(diethylamino)ethyl acrrylate. Among these, alkyl methacrylate is preferable, particularly, methyl methacrylate is preferable. These compounds may be used as one kind alone, and as a mixture of two kinds or more.

(4)

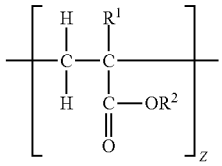

In the above formulae, $R^1$ and $R^2$ have the same meanings as in the A component and B component.

(3)

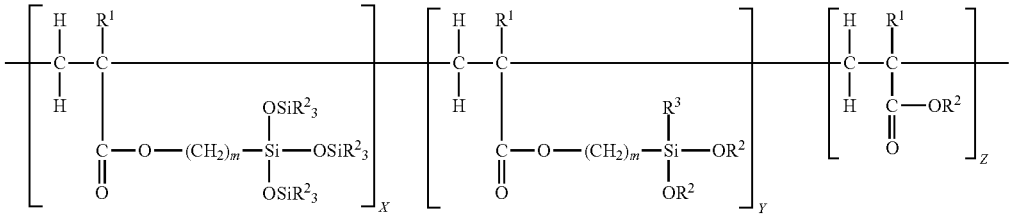

In the case of this tertiary acrylic copolymer, being accompanied with C component added, the ratio of each component (X, Y, Z) differs naturally from the case of the foregoing binary acrylic copolymer, as the ratio of each component (X, Y, Z), Z is 30 to 80 mol %. Further preferably, it is 35 to 75 mol %, and 60 mol %<Y+Z<90 mol %, further preferably, 70 mol %<Y+Z<85 mol %. Namely, X is 10 to 40 mol %. C component provides the coating with flexibility and makes adhesiveness between core material and coating better. When the C component is less than 30 mol %, no sufficient adhesiveness is obtained, whereas when it is more than 80 mol %, since either X or Y becomes 10 or less, it becomes difficult to satisfy water repellency of carrier coating, hardness and flexibility (film scraping) at the same time.

As a technique enhancing durability by crosslink of coating, there is one described in Japanese Patent No. 3691115. Namely, in regard to the one described in Japanese Patent No. 3691115 specification, it is a carrier for an electrostatic image development characterized by coating the surface of magnetic particle with a thermosetting resin that a copolymer of an organopolysiloxane having at least a vinyl group at the end and a radical copolymerizable monomer having at least one functional group selected from the group consisting of hydroxyl group, amino group, amide group and imide group is cross-linked by an isocyanate compound, but the actual situation is that no sufficient durability on peeling and scraping of coating is obtained.

Although the reason has been not cleared sufficiently, in the case of thermosetting resin that the foregoing copolymer is cross-linked by an isocyanate compound, as is known from the structural formula, functional groups (active hydrogen-containing groups) per unit weight reacting (cross-linking) an isocyanate compound in a copolymer resin are too few to form a two-dimensionally or three-dimensionally dense crosslink structure at a crosslink point. Therefore, it is inferred that in a prolonged use, peeling and scraping of coating occur easily (abrasion resistance of coating is poor), so a sufficient durability is not obtained.

When peeling and scraping of coating occur, change of image quality due to the lowering of carrier resistance and carrier adhesion take place. Peeling and scraping of coating deteriorates flow properties of developer, leading to the lowering of amount scooped, and causing the lowering of image concentration, scumming due to TC up, and scattering of toner.

In the present invention, it uses a copolymer resin having a lot of functional groups (points) capable of cross-linking being difunctional or trifunctional per resin unit weight (per unit weight, as many as 2 to 3 times), and this is further cross-linked by condensation polymerization, hence it is thought that coating is very tough and hardly scraped, leading to high durability.

Compared with crosslink by an isocyanate compound, crosslink by siloxane bond in the present invention is larger in bond energy and more stable to heat stress, hence it is inferred that stability of coating with time is maintained.

As a catalyst for condensation polymerization of cross-linking component B, a titanium catalyst, tin catalyst, zirconium catalyst and aluminum catalyst are listed, but the present invention is based on the finding that among various kinds of these catalysts, of titanium catalyst bringing a good result, in particular, titanium alkoxide and titanium chelate give the most preferable result as a catalyst. It is thought that this catalyst has a large effect to promote condensation reaction of silanol group and is hard to deactivate. As an example of titanium alkoxide catalyst, titanium diisopropoxybis(ethyl acetoacetate) is listed (chemical formula is structural formula 2), and as an example of titanium chelate catalyst, titanium diisopropoxybis(triethanolamininate) is listed (chemical formula is structural formula 3).

$Ti(O\text{-}i\text{-}C_3H_7)_2(C_6H_9O_3)_2$ [Structural formula 2]

$Ti(O\text{-}i\text{-}C_3H_7)_2(C_6H_{14}O_3N)_2$ [Structural formula 3]

Additionally, the coating layer can be formed by using a composition for a coating layer including a silicone resin having a silanol group and/or a hydrolysable functional group, titanium diisopropoxybi (ethyl acetoacetate) catalyst, according to need, a resin other than a silicone resin having a silanol group and/or a hydrolysable functional group, and a solvent. Specifically, it may be formed by condensation of silanol groups while a particulate core material is covered with a composition for a coating layer, or it may be formed by condensation of silanol groups after a particulate core material is covered with a composition for a coating layer. As the method for condensation of silanol groups while a particulate core material is covered with a composition for a coating layer, it is not particularly restricted, there is listed a method of covering a particulate core material with a composition for a coating layer while heat, light etc. are provided, or the like. As the method for condensation of silanol groups after a particulate core material is covered with a composition for a coating layer, it is not particularly restricted, there is listed a method of heating after a particulate core material is covered with a composition for a coating layer, or the like.

As a resin other than a silicone resin having a silanol group and/or a hydrolysable functional group, it is not particularly restricted, there are listed an acrylic resin, amino resin, polyvinyl resin, polystyrene resin, halogenated olefin resin, polyester, polycarbonate, polyethylene, polyvinyl fluoride, polyvinylidene fluoride, polytrifluoroethylene, polyhexafluoropropylene, copolymer of vinylidene fluoride and vinyl fluoride, fluoroterpolymer such as terpolymer of tetrafluoroethylene, vinylidene fluoride and non-fluoride monomer, silicon resin not having a silanol group or a hydrolysable functional group etc., and two kinds or more may be concomitantly used. Above all, an acrylic resin is preferable because adhesion to a particulate core material and conductive particle is strong, and brittleness is low.

Regarding the acrylic resin, the glass transition point is preferably 20 to 100° C., and further preferably 25 to 80° C. Since such acrylic resin has a suitable elasticity, when giving frictional electrification to a developer, in the case of accompanying a strong impact on a coating layer due to friction between toner and carrier, or of carries each other, the impact can be absorbed, and the coating layer can be maintained without damaging it.

It is further preferable that the coating layer contains a cross-linked material of acrylic resin and amino resin. From this, fusion of coating layers themselves can be suppressed while a suitable elasticity is maintained. The amino resin is not particularly restricted, and a melamine resin or benzoguanamine resin is preferable because charging capability of carrier can be improved. In the case that charging capability of carrier needs to be suitably controlled, other amino resin may be used concomitantly used with a melamine resin and/or benzoguanamine resin.

As an acrylic resin capable of cross-linking an amino resin, one having a hydroxyl group and/or a carboxyl group is preferable, and one having a hydroxyl group is further preferable. From this, adhesion to a particulate core material and conductive particle can be further improved, and dispersion stability of conductive particle can be improved as well. In this case, the hydroxyl value of acrylic resin is preferably 10 mg KOH/g or more, and further preferably 20 mg KOH/g or more.

In the present invention, it is preferable that the composition for a coating layer contains a conductive particle. From this, volume resistivity of carrier can be controlled. The conductive particle is not particularly restricted, and carbon black, ITO, tin oxide, zinc oxide and the like are listed, and two kinds or more may be concomitantly used.

The addition amount of conductive particle is preferably 0.1 to 1000% by mass relative to silicone resin. When the addition amount of conductive particle is less than 0.1% by mass, an effect of controlling volume resistivity of carrier sometimes becomes insufficient, whereas when more than 1000% by mass, it becomes difficult to hold a conductive particle, and the surface layer of carrier tends to be destroyed.

As a conductive particle used in the present invention, a conductive fine particle including barium sulfate can be used.

—Barium Sulfate—

In regard to the above-described carrier for an electrostatic latent image developer, it is important that the above-described coating layer contains barium sulfate. When barium sulfate is contained in the coating layer, the charging property to toner is high, and it becomes difficult for the external additive and toner resin to be spent in the surface layer. This may be because of the fact that the adhered additive and resin tend to be detached by friction with other carriers because the hardness of barium sulfate is higher than that of the resin of the coating layer. Hence, the carrier for an electrostatic latent image developer can maintain the charging property after output in a large image area for a long time.

Further, by adding barium sulfate, other effects can also be expected.

When an operation is conducted in a small image area (a state low in balance of toner) for a long time, the carrier coating layer is scraped to expose the core material, resistance of the carrier lowers, and there is a problem that an abnormal image like a white blob is generated on the image by development of the carrier.

However, by adding barium sulfate particles to a resin in the form of a dispersion, strength of the coating layer increases, and the layer serving as a carrier film is hardly scraped. Accordingly, even when a development device is operated for a long time in a state low in balance of toner, the amount of the coating layer scraped is small, and the carrier can be used for a far longer time than the coating layer covered only with a resin.

Here, the ratio of Ba and Si contents to the whole elements measured by an X-ray photoelectron spectroscopy (XPS), Ba/Si, is preferably not less than 0.01 and not more than 0.08.

When the Ba/Si ratio is less than 0.01, since the charging ability by Ba is insufficient, the charge cannot be maintained, and a problem such as scumming and scattering of toner arises. Since the amount of barium sulfate is small, the coating layer tends to be scraped, and a problem of carrier adhesion tends to occur.

On the other hand, when the Ba/Si ratio is more than 0.08, since the charging amount is too large, the development ability cannot be obtained sufficiently. Since the amount of barium sulfate to the resin is too large, the dispersed particle diameter deteriorates, and the barium sulfate particles are present in a state where they are aggregated, thus, barium sulfate is easily detached, causing a problem such as scumming and scattering of toner.

Additionally, the Ba/Si ratio is preferably not less than 0.03. This is because that a sufficient charging amount may not be obtained by the Ba/Si ratio in a case of use in a large image area rate as in the printing business or the like.

As the content of Ba to the whole elements measured by an X-ray photoelectron spectroscopy (XPS), it is not particularly restricted and suitably selected according to the purpose. It is preferably 0.2 atomic % (number) to 1.2 atomic % (number).

When the content of Ba is less than 0.2 atomic % (number), since the charging amount by Ba is insufficient, the charge cannot be maintained, and a problem such as scumming and scattering of toner may occur, whereas when the content is more than 1.2 atomic % (number), since the charging amount is too large, a sufficient development ability may not be obtained.

The method for adjusting the Ba/Si ratio is not particularly restricted, but adjustment of the content of barium sulfate is effective.

The content of barium sulfate is preferably 2 parts by mass to 12 parts by mass, more preferably 4 parts by mass to 10 parts by mass, and particularly preferably 6 parts by mass to 10 parts by mass, relative to 100 parts by mass of the silicone resin.

When the content is less than 2 parts by mass, since the amount of barium present in the surface decreases and a sufficient charging ability cannot be obtained, there may be a case that a problem such as scumming and scattering of toner arises, and when the content is more than 12 parts by mass, the amount of barium sulfate in a resin is saturated, and the coating film may be brittle.

In dispersing barium sulfate in a carrier coating liquid (composition for a coating layer), it is important to employ a process capable of dispersing barium sulfate more finely. This is because a finer dispersion at the same amount of formula gives a larger surface area of barium sulfate, thus, the surface area occupied in the carrier coating surface naturally becomes large as well. Since the strength of the coating layer increases, the resistance of the carrier would not decrease even if a stronger stress is applied thereto.

Herein, the ratio of contents of Ba and Si, Ba/Si, is measured using an X-ray photoelectron spectrometer (XPS). The detail is described below.

Measuring apparatus: AXIS-ULTRA manufactured by Kratos

| | | |
|---|---|---|
| Light source for measurement: | | Al (monochrome meter) |
| Power for measurement: | | 90 W (15 kV, 6mA) |
| Field of measurement: | | 900 × 600 ($\mu m^2$) |
| Pass energy: | (wide scan) | 160 eV, |
| | (narrow scan) | 40 eV |
| Energy step: | (Wide scan) | 1.0 eV, |
| | (narrow scan) | 0.2 eV |

Relative sensitivity coefficient: Kratos' relative sensitivity coefficient is used Because it is a magnetic material, the measurement is conducted in a condition where MAGNET CONTROLLER is OFF.

For the above-described measurement, a sample is put in a chip with a cylindrical hole of 0.3 mm in depth, and the flat part of the surface is measured. The measurement result is expressed in terms of atomic % (number), and the ratio of this measurement data is used.

Further, the ratio of the average particle diameter D of barium sulfate contained in the coating layer to the thickness h of the coating layer is preferably $1.0<D/h<2.0$.

When the D/h ratio is less than 1.0, since the fine particles of barium sulfate are buried in a binding resin, the amount of barium sulfate serving as a convex decreases, and there may be a case that a toner spent suppressing effect cannot be obtained sufficiently. Since the amount of particles serving as a convex is small, the binding resin layer is easily scraped, and there is a problem that the resistance largely decreases in stirring the carrier for a long time.

When the D/h ratio is more than 2.0, the contact area between barium sulfate and the binding resin is small, thus, a sufficient binding force is not obtained, and barium sulfate may be easily detached. In the case that barium sulfate is detached, the resistance is lowered.

The measuring method of the thickness h of a resin part in the coating layer is not particularly restricted. For example, using a transmission electron microscope (TEM), the cross-section of the carrier may be observed to measure the thickness of the resin part in the coating layer covering the carrier surface, and the thickness can be obtained from the average value thereof. Specifically, only the thickness of a resin part present between the core material surface and the particles is measured. Neither the thickness of the resin part present between particles nor the thickness of the resin part on an inorganic particle is included. The average of arbitrary 50 measurements of the cross-section of the carrier is obtained, which can be used as the thickness h (μm).

The measuring method of the average particle diameter (D) of barium sulfate is not particularly restricted. For example, a volume average particle diameter is measured by an automatic particle size distribution analyzer, CAPA-700 (manufactured by Horiba, Ltd.). As a pretreatment for measurement, in a juice mixer, 30 ml of aminosilane (SH6020: manufactured by Toray Dow Corning Silicone Co., Ltd.) and 300 ml of a toluene solution are put. To the mixer, 6.0 g of a sample is added, the rotation speed of the mixer is set "low", and the sample is dispersed for 3 minutes. In 500 ml of a toluene solution previously prepared in a 1,000 ml-beaker, an appropriate amount of the dispersion liquid is added for dilution. The diluted liquid is continuously stirred in a homogenizer. This diluted solution is subjected to measurement by an automatic particle size distribution analyzer of ultracentrifugal type, CAPA-700.

Rotation speed: 2,000 rpm
Maximum particle size: 2.0 μm
Minimum particle size: 0.1 μm
Interval of particle size: 0.1 μm
Viscosity of dispersion medium: 0.59 mPa·S
Density of dispersion medium: 0.87 g/cm$^3$
Density of particles: for the density of barium sulfate, an absolute specific density value measured using a dry automatic high-density meter, Accupyc 1330 (manufactured by Shimadzu Corporation) is input.

As another conductive fine particle used in the present invention, a tin oxide fine particle having carbon in its surface can be used.

When carbon adheres to the surface of the tin oxide fine particle, stability with time in resistance of tin oxide is given. Although the relationship between the carbon amount on the surface and the resistance of conductive tin oxide is not clear, when the carbon amount on the surface is too large, the stability with time in resistance of conductive tin oxide deteriorates. Further, in mixing into toner, there is a problem of color smear similarly to the case of carbon black due to scraping of the carrier film or the like, thus, the carbon amount on the surface needs to be very small. The carbon amount on a conductive fine particle can be quantitatively analyzed using a high-frequency combustion infrared absorption method (manufactured by LECO Corporation, IR-412 type).

A tin oxide fine particle having carbon in its surface (conductive fine particle) can be obtained, for example, by immersing a tin oxide fine powder in ethanol, and conducting surface-modifying treatment by maintaining it under nitrogen atmosphere.

In the present invention, it is preferable that the composition for a coating layer contains a silane coupling agent. From this, conductive particles can be dispersed stably.

The silane coupling agent is not particularly restricted, and there are listed

γ-(2-aminoethyl)aminopropyltrimethoxysilane,
γ-(2-aminoethyl)aminopropylmethyldimethoxysilane,
γ-methacryloxypropyltrimethoxysilane,
N-β-(N-vinylbenzylaminoethyl)-γ-aminopropyltrimethoxysilane hydrochloride, γ-glycidoxypropyltrimethoxysilane,
γ-mercaptopropyltrimethoxysilane, methyltrimethoxysilane, methyltriethoxysilane, vinyltriacetoxysilane,
γ-chloropropyltrimethoxysilane, hexamethyldisilazane,
γ-anilinopropyltrimethoxysilane, vinyltrimethoxysilane, octadecyldimethyl[3-(trimethoxysilyl)propyl]ammonium chloride, γ-chloropropylmethyldimethoxysilane,
methyltrichlorosilane, dimethyldichlorosilane, trimethylchlorosilane, allyltriethoxysilane,
3-aminopropylmethyldiethoxysilane,
3-aminopropyltrimethoxysilaene, dimethyldiethoxysilane,
1,3-divinyltetramethyldisilazane,
methacryloxyethyldimethyl(3-trimethoxysilylpropyl)ammonium chloride etc., and two kinds or more may be concomitantly used.

As a commercial product of silane coupling agent, there are listed AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, Z-6940 (manufactured by Toray Silicone Co., Ltd.) and the like.

The addition amount of silane coupling agent is preferably 0.1 to 10% by mass relative to silicone resin. When the addition amount of silane coupling agent is less than 0.1% by mass, adhesion to a particulate core material, a conductive particle and a silicone resin lowers, and a coating layer is sometimes detached in a prolonged use, whereas when more than 10% by mass, filming of toner occurs sometimes in a prolonged use.

In the present invention, it is preferable that an average film thickness of a coating layer is 0.05 to 4 μm. When the average film thickness is less than 0.05 μm, the coating layer tends to be destroyed, and the film is sometimes scraped, whereas when more than 4 μm, since the coating layer is not a magnetic material, a carrier adheres easily to an image.

In the present invention, the particulate core material is not particularly restricted as long as it is a magnetic material, and there are listed an electromagnetic material such as iron and cobalt; iron oxide such as magnetite, hematite and ferrite; various kinds of alloys or compounds; resin particle that these magnetic materials are dispersed in a resin, and the like. Above all, from considerations on environment, Mn ferrite, Mn—Mg ferrite, Mn—Mg—Sr ferrite etc. are preferable.

In the present invention, it is preferable that a weight average particle diameter of particulate core material is 20 to 65 μm. When the weight average particle diameter is less than 20 μm, carrier adhesion sometimes occurs, whereas when more than 65 μm, reproducibility of image detail lowers, and there is a case that a detailed image cannot be formed.

Additionally, a weight average particle diameter can be measured by using a micro-track particle size distribution tester, model HRA9320-X100 (manufactured by Nikkiso Co., Ltd.).

Regarding the carrier of the present invention, it is preferable that magnetization at a magnetic filed of 1 kOe ($10^6/4\pi$ [A/m]) is 40 to 90 Am$^2$/kg. When this magnetization is less than 40 Am$^2$/kg, carrier adheres to an image sometimes, whereas when more than 90 Am$^2$/kg, a magnetic ear becomes rigid and a hazed image occurs sometimes.

Additionally, magnetization can be measured by using VSM-P7-15 (manufactured by Toei Industry Co., Ltd.).

Regarding the carrier of the present invention, it is preferable that volume resistivity is $1\times10^9$ Ω·cm to $1\times10^{17}$ Ω·cm. When the volume resistivity is less than $1\times10^9$ Ω·cm, carrier adhesion sometimes occurs in a non-image part, whereas when more than $1\times10^{17}$ Ω·cm, there is a case that an edge effect becomes an unacceptable level.

Additionally, the volume resistivity can be measured by using a cell shown in FIG. 1. Specifically, first, in a cell composed of a fluorine resin container (2) where an electrode (1*a*) and electrode (1*b*) of surface area 2.5 cm×4 cm are accommodated at a distance of 0.2 cm, a carrier (3) is filled, and tapped 10 times at a tapping speed of 30 times/min from a dropping height of 1 cm. Next, direct voltage of 1000 V was applied between the electrodes (1*a*) and (1*b*), and resistance r [Ω] after 30 seconds is measured by using a high-resistance meter 4329A (manufactured by Yokogawa Hewlett-Packard Co., Ltd.), and volume resistivity [Ω·cm] can be calculated from the following formula.

$$r\times(2.5\times4)/0.2 \qquad \text{[Mathematical formula 1]}$$

The developer of the present invention has the carrier and toner of the present invention.

The toner contains a binding resin and a colorant, may be either of a monochrome toner and a color toner. The toner may contain a release agent in order to be applied to an oil-free system where oil for preventing toner from adhesion to a fixing roll is not coated. In general, such toner tends to generate filming, but since the carrier of the present invention can prevent filming, the developer of the present invention can maintain a good quality over a long period of time. Further, color toner, particularly, yellow toner generally has a problem that color smear occurs due to scraping of the coating layer of carrier, but the developer of the present invention can suppress occurrence of color smear.

A toner can be produced using a known method such as grinding technique and polymerization technique. For example, in the case of producing a toner using a grinding technique, first, a melt-kneaded material obtained by kneading toner raw materials is cooled, then, ground and classified to produce a parent particle. Next, in order to improve transferability and durability, an external additive is added to the parent particle, thereby producing a toner.

In this time, an apparatus for kneading toner raw materials is not particularly restricted, and there are listed two rolls of batch type; BANBURY mixer; a continuous biaxial extruder such as KTK-type biaxial extruder (manufactured by Kobe Steel, Ltd.), TEM-type biaxial extruder (manufactured by Toshiba Machine Co., Ltd.), biaxial extruder (manufactured by KCK Corporation), PCM-type biaxial extruder (manufactured by Ikegai Co., Ltd.), KEX-type biaxial extruder (manufactured by Kurimoto, Ltd.); a continuous uniaxial kneader such as co-kneader (manufactured by Buss Corporation) and the like.

In grinding a melt-kneaded material cooled, after it was coarsely ground using a hammer mill, ROTOPLEX or the like, then, can be finely ground using a fine grinding mill using jet stream, a mechanical fine grinding mill or the like. Additionally, it is preferable to be ground for the average particle diameter to be 3 to 15 μm.

Further, in classifying the melt-kneaded material ground, a wind-type classifying machine or the like can be used. Additionally, it is preferable to be classified for the average particle diameter of parent particle to be 5 to 20 μm. In adding an external additive to the parent particle, by mixing and stirring using mixers, while the external additive is pulverized, it adheres to the surface of the parent particle.

The binding resin is not particularly restricted, and there are listed a single polymer of styrene and its derivative such as polystyrene, poly(p-styrene) and polyvinyltoluene; a styrene copolymer such as styrene-p-chlorostylene copolymer, styrene-propylene copolymer, styrene-vinyltoluene copolymer, styrene-methyl acrylate copolymer, styrene-ethyl acrylate copolymer, .styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer; poly(methyl methacrylate), poly(butyl methacrylate), polyvinylchloride, polyvinyl acetate, polyethylene, polyester, polyurethane, epoxy resin, polyvinyl butyral, poly (acrylic acid), rosin, modified rosin, terpene resin, phenolic resin, aliphatic or aromatic hydrocarbon resin, aromatic petroleum resin etc., and two kinds or more may be concomitantly used.

The binding resin for pressure-fixing is not particularly restricted, and there are listed polyolefin such as low-molecular weight polyethylene and low-molecular weight polypropylene; olefin copolymer such as ethylene-acrylic acid copolymer, ethylene-acrylate copolymer, styrene-methacrylic acid copolymer, ethylene-methacrylate copolymer, ethylene-vinyl chloride copolymer, ethylene-vinyl acetate copolymer and ionomer resin; epoxy resin, polyester, styrene-butadiene copolymer, polyvinylpyrrolidone, methyl vinyl ether-anhydrous maleic acid copolymer, maleic acid-modified phenolic resin, phenol-modified terpene resin etc., and two kinds or more may be concomitantly used.

The colorant (pigment or dye) is not particularly restricted, and there are listed a yellow pigment such as cadmium yellow, mineral fast yellow, nickel titanium yellow, Naples yellow, naphthol yellow S, Hansa yellow G, Hansa yellow 10G, benzidine yellow GR, qunoline yellow lake, permanent yellow NCG and tartrazine lake; an orange pigment such as molybdenum orange, permanent orange GTR, pyrazolone orange, Vulcan orange, indanthrene brilliant orange RK, benzidine orange G and indanthrene brilliant orange GK; a red pigment such as iron red, cadmium red, permanent red 4R, lithol red, pyrazolone red, watching red calcium salt, lake red D, brilliant carmine 6B, eosin lake, rhodamine lake B, alizarin lake and brilliant carmine 3B; a violet pigment such as fast violet B and methyl violet lake; a blue pigment such as cobalt blue, alkali blue, Victoria blue lake, phthalocyanine blue, non-metal phthalocyanine blue, phthalocyanine blue-partly chloride, fast sky blue and indanthrene blue BC; a green pigment such as chromium green, chromium oxide, pigment green B and malachite green lake; a black pigment including carbon black, oil furnace black, channel black, lampblack, acetylene black, an azine color such as aniline black, metal salt azo color, metal oxide, complex metal oxide, and two kinds or more may be concomitantly used.

The release agent is not particularly restricted, and there are listed polyolefin such as polyethylene and polypropylene, fatty acid metal salt, fatty acid ester, paraffin wax, amide wax, polyhydric wax, silicone varnish, carnauba wax and ester wax etc., and two kinds or more may be concomitantly used.

The toner may further contain a charge controlling agent. The charge controlling agent is not particularly restricted, and there are listed nigrosine; an azine dye having an alkyl group having 2 to 16 carbon atoms (see Japanese Examined Patent Publication No. 42-1627); a basic dye such as C.I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040) and C. I. Basic Green 4 (I. C. 42000); and a lake pigment of these basic dyes; a quaternary ammonium salt such as C. I. Solvent Black 8 (C. I. 26150), benzoylmethylhexadecylammonium chloride and decyltrimethyl chloride; a dialkyltin compound such as dibutyl and dioctyl; a dialkyltin borate compound; a guanidine derivative; a polyamine resin such as vinyl polymer having an amino group and condensation polymer having an amino group; a metal complex salt of monoazo dye described in Japanese Examined Patent Publication No. 41-20153, 43-27596, 44-6397 and 45-26478; salicylic acid described in Japanese Examined Patent Publication No. 55-42752 and 59-7385; a metal complex with Zn, Al, Co, Cr, Fe etc. of dialkylsalicylic acid, naphthoic acid and dicarboxylic acid; a sulfonated copper phthalocyanine pigment; organic boron acid slats; fluorine-containing quaternary ammonium salt; calixarene compound etc., and two kinds or more may be concomitantly used. Additionally, in a color toner other than black, a white metal salt of salicylic acid derivative is preferable.

The external additive is not particularly restricted, and there are listed an inorganic particle such as silica, titanium oxide, alumina, silicon carbide, silicon nitride and boron nitride; a resin particle such as poly(methyl methacrylate) particle with an average particle diameter of 0.05 to 1 μm obtained by a soap-free emulsion polymerization technique and a polystyrene particle, and two kinds or more may be concomitantly used. Above all, preferable are silica and a metal oxide particle such as titanium oxide, whose surface is subjected to hydrophobic treatment. Further, in concomitant use of silica subjected to hydrophobic treatment and titanium oxide subjected to hydrophobic treatment, by setting the addition amount of titanium oxide subjected to hydrophobic treatment more than that of silica subjected to hydrophobic treatment, a toner excellent in charge stability to humidity is obtained.

[Image Forming Device, Image Forming Method]

The image forming method of the present invention comprises a process for forming an electrostatic latent image on an electrostatic latent image support; a process for forming a toner image by developing the electrostatic latent image formed on the electrostatic latent image support using a developer of the present invention; a process for transferring the toner image formed on the electrostatic latent image support to a recording medium; and a process for fixing the toner image transferred on the recording medium.

Figure 2:
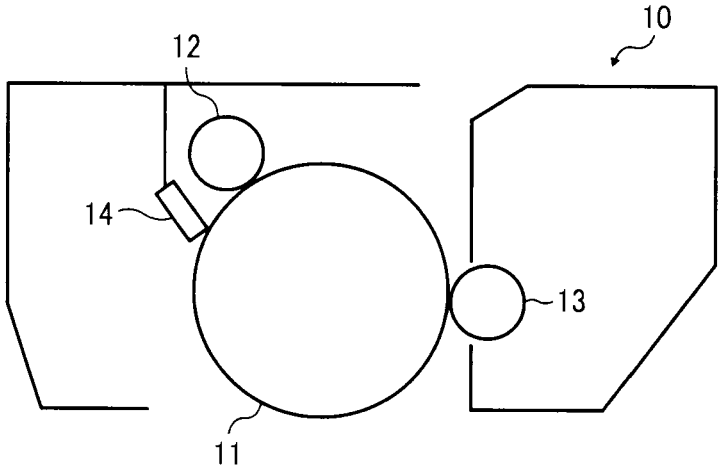
FIG. 2 is a schematic view illustrating an embodiment of the process cartridge of the present invention.

One example of the process cartridge of the present invention is shown in FIG. 2. A process cartridge (10) is integrated by a photosensitive body (11), a charging device (12) for charging the photosensitive body (11), a development device (13) for forming a toner image by developing an electrostatic latent image formed on the photosensitive body (11) using a developer of the present invention, and a cleaning device (14) for removing the toner let on photosensitive body (11) after transferring the toner image formed on the photosensitive body (11) to a recording medium, and the process cartridge (10) is detachable to a main body of an image forming device such as facsimile and printer.

Hereinafter, a method for forming an image using an image forming device that a process cartridge (10) is mounted is explained. First, a photosensitive body (11) is driven and rotated at a predetermined circumferential velocity, by a charging device (12), the circumferential surface of photosensitive body (11) is uniformly charged at a predetermined positive or negative potential. Next, from an exposure device (not shown in the figure) such as exposure device of slit exposure system and exposure device of scanning exposure by laser beam, exposure light is irradiated onto the circumferential surface of photosensitive body (11) to form an electrostatic latent image sequentially. Further, the electrostatic latent image formed on the circumferential surface of photosensitive body (11) is developed by a development device (13) using a developer of the present invention to form a toner image. Next, the toner image formed on the circumferential surface of photosensitive body (11) is synchronized with the rotation of photosensitive body (11), and transferred sequentially to a transfer paper fed between the photosensitive body (11) and a transfer device (not shown in the figure) from a paper feeding part (not shown in the figure). Further, the transfer paper that the toner image was transferred is separated from the circumferential surface of photosensitive body (11) and introduced into a fixing device (not shown in the figure) and fixed, then, printed out to the outside of the image forming device as a copy. On the other hand, regarding the surface of photosensitive body (11) after the toner image is transferred, the residual toner is removed for cleanup by a cleaning device (14), then it is discharged by a discharging device (not shown in the figure) to use for image formation repeatedly.

The carrier of the present invention is used in a supplementary developer composed of carrier and toner, and it is applied to an image forming device for conducting image formation while an excess developer in a development device is exhausted, thereby a stable image quality is obtained for a very long period of time. Namely, the deteriorated carrier inside a development device and a carrier not deteriorated in a supplementary developer are interchanged to maintain the charging amount stably over a long time, so that a stable image is obtained. The present system is particularly effective in printing a large image area. In printing a large image area, charge deterioration of carrier due to spent toner to a carrier is a main part of carrier deterioration, by using the present system, in printing a large image area, since the amount of replenishing carrier becomes large, frequency of interchanging the deteriorated carrier increases. From this, a stable image is obtained over a very long period of time.

The mixing ratio of a supplementary developer is preferably set in such manner that a toner has a compounding ratio of 2 to 50 parts by mass relative to 1 part by mass of carrier. When the toner is less than 2 parts by mass, the amount of replenishing carrier is too much, leading to an excess supply of carrier, and carrier concentration in a development device becomes too high, hence, the charging amount of developer tends to increase. Resulting from an increase in the charging amount of developer, development ability lowers and image concentration lowers. When more than 50 parts by mass, the ratio of carrier in a supplementary developer becomes small, hence, interchange of carrier in an image forming device becomes small, and an effect on carrier deterioration cannot be expected.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis Example of Resin

Example 1 of Resin Synthesis

Synthesis Example 1 of Binary Copolymer)

To a flask equipped with a stirrer, condenser, thermometer, nitrogen-introducing tube and dropping device, 500 g of toluene was charged, and temperature was raised to 90° C. under nitrogen stream. Next, a mixture of 211 g (500 mmol) of 3-methacryloxypropyltris(trimethylsiloxy)silane, Silaplane TM-0701T (manufactured by Chisso Corporation), 124.0 g (500 mmol) of 3-methacryloxypropyltrimethoxysilane and 0.58 g (3 mmol) of 2,2'-azobis(2-methylbutyronitrile) was added dropwise over 1 hour. Further, a solution that 0.06 g (0.3 mmol) of 2,2'-azobis(2-methylbutyronitrile) was dissolved in 15 g of toluene was added, then, mixed at 90 to 100° C. for 3 hours to obtain a resin 1. The resin 1 had a weight average molecular weight of 35000. A solution of resin 1 diluted with toluene for the nonvolatile portion to be 25 mass % had a viscosity of 8.5 $mm^2$/sec and a specific gravity of 0.91.

Example 2 of Resin Synthesis

Synthesis Example 2 of Binary Copolymer

A resin 2 was obtained in the same way as in the resin 1 except that 130 g (500 mmol) of 3-methacryloxypropylmethyldiethoxysilane was used in place of 124.0 g (500 mmol) of 3-methacryloxypropyltrimethoxysilane. The resin 2 had a weight average molecular weight of 33000. A solution of resin 2 diluted with toluene for the nonvolatile portion to be 25 mass % had a viscosity of 8.6 $mm^2$/sec and a specific gravity of 0.92.

Example 3 of Resin Synthesis

Synthesis Example 3 of Binary Copolymer

A resin 3 was obtained in the same way as in the resin 1 except that the addition amounts of 3-methacryloxypropyltris (trimethylsiloxy)silane, Silaplane TM-0701T (manufactured by Chisso Corporation) and 3-methacryloxypropyltrimethoxysilane were changed to 379.8 g (900 mmol) and 24.8 g (100 mmol), respectively. The resin 3 had a weight average molecular weight of 34000. A solution of resin 3 diluted with toluene for the nonvolatile portion to be 25 mass % had a viscosity of 8.7 $mm^2$/sec and a specific gravity of 0.90.

Example 4 of Resin Synthesis

Synthesis Example 4 of Binary Copolymer

A resin 4 was obtained in the same way as in the resin 1 except that the addition amounts of 3-methacryloxypropyltris (trimethylsiloxy)silane, Silaplane TM-0701T (manufactured by Chisso Corporation) and 3-methacryloxypropyltrimethoxysilane were changed to 42.2 g (100 mmol) and 223.2 g (900 mmol), respectively. The resin 4 had a weight average molecular weight of 37000. A solution of resin 4 diluted with toluene for the nonvolatile portion to be 25 mass % had a viscosity of 8.4 $mm^2$/sec and a specific gravity of 0.92.

Example 5 of Resin Synthesis

Synthesis Example 5 of Binary Copolymer

A resin 5 was obtained in the same way as in the resin 1 except that
in place of 211 g (500 mmol) of 3-methacryloxypropyltris (trimethylsiloxy)silane, Silaplane TM-0701T (manufactured by Chisso Corporation) and 124.0 g (500 mmol) of 3-methacryloxypropyltrimethoxysilane, 168.5 g (250 mmol) of 4-acryloxybutyltris(triisopropylsiloxy)silane and 83 g (250 mmol) of 3-methacryloxypropyltriisopropoxysilane were used. The resin 5 had a weight average molecular weight of 39000. A solution of resin 5 diluted with toluene for the nonvolatile portion to be 25 mass % had a viscosity of 8.9 $mm^2$/sec and a specific gravity of 0.94.

Example 6 of Resin Synthesis

Synthesis Example 1 of Ternary Copolymer

To a flask equipped with a stirrer, condenser, thermometer, nitrogen-introducing tube and dropping device, 300 g of toluene was charged, and temperature was raised to 90° C. under nitrogen stream. Next, a mixture of 84.4 g (200 mmol) of 3-methacryloxypropyltris(trimethylsiloxy)silane, Silaplane TM-0701T (manufactured by Chisso Corporation), 37.2 g (150 mmol) of 3-methacryloxypropyltrimethoxysilane, 65.0 g (650 mmol) of methyl methacrylate and 0.58 g (3 mmol) of 2,2'-azobis(2-methylbutyronitrile) was added dropwise over 1 hour. Further, a solution that 0.06 g (0.3 mmol) of 2,2'-azobis(2-methylbutyronitrile) was dissolved in 15 g of toluene was added, then, mixed at 90 to 100° C. for 3 hours to obtain a resin 6. The resin 6 had a weight average molecular weight of 34000. A solution of resin 6 diluted with toluene for the nonvolatile portion to be 25 mass % had a viscosity of 8.7 $mm^2$/sec and a specific gravity of 0.91.

Example 7 of Resin Synthesis

Comparative Synthesis Example 1 of Resin

A resin 7 was obtained in the same way as in the resin 1 except that the addition amounts of 3-methacryloxypropyltris (trimethylsiloxy)silane, Silaplane TM-0701T (manufactured by Chisso Corporation) and 3-methacryloxypropyltrimethoxysilane were changed to 422 g (1000 mmol) and 0 g (0 mmol), respectively. The resin 7 had a weight average molecular weight of 37000. A solution of resin 7 diluted with toluene for the nonvolatile portion to be 25 mass % had a viscosity of 8.4 $mm^2$/sec and a specific gravity of 0.91.

Example 8 of Resin Synthesis

Comparative Synthesis Example 2 of Resin

A resin 8 was obtained in the same way as in the resin 1 except that the addition amounts of 3-methacryloxypropyltris (trimethylsiloxy)silane, Silaplane TM-0701T (manufactured by Chisso Corporation) and 3-methacryloxypropyltrimethoxysilane were changed to 0 g (0 mmol) and 248 g (1000 mmol), respectively. The resin 8 had a weight average molecular weight of 33000. A solution of resin 8 diluted with toluene for the nonvolatile portion to be 25 mass % had a viscosity of 8.7 $mm^2$/sec and a specific gravity of 0.90.

Example 9 of Resin Synthesis

Comparative Synthesis Example 3 of Resin

To a flask equipped with a stirrer, condenser, thermometer, nitrogen-introducing tube and dropping device, 100 parts of methyl ethyl ketone was charged, and temperature was raised to 80° C. under nitrogen stream. Next, a solution that 32.6 parts of methylmethacrylate, 2.5 parts of 2-hydroxyethyl methacrylate, 64.9 parts of 3-methacryloxypropyltris(trimethylsiloxy) silane and 1 part of 1,1'-azobis(cyclohexane-1-carbonitrile) were dissolved in 100 parts of methyl ethyl ketone was added dropwise over 2 hours, and aged for 5 hours to obtain a resin 9. The resin 9 had a weight average molecular weight of 45000. A solution of resin 9 diluted with toluene for the nonvolatile portion to be 25 mass % had a viscosity of 9.4 $mm^2$/sec and a specific gravity of 0.94.

Example 10 of Resin Synthesis

Comparative Synthesis Example 4 of Resin

A resin 10 was obtained in the same way as in the resin 6 except that the addition amounts of 3-methacryloxypropyltris (trimethylsiloxy)silane, Silaplane TM-0701T (manufactured by Chisso Corporation), 3-methacryloxypropyltrimethoxysilane and methyl methacrylate were changed to 211 g (500 mmol), 0 g (0 mmol) and 50.0 g (500 mmol), respectively. The resin 10 had a weight average molecular weight of 34000. A solution of resin 10 diluted with toluene for the nonvolatile portion to be 25 mass % had a viscosity of 8.7 $mm^2$/sec and a specific gravity of 0.91.

Example 11 of Resin Synthesis

Comparative Synthesis Example 5 of Resin

A resin 11 was obtained in the same way as in the resin 6 except that the addition amounts of 3-methacryloxypropyltris (trimethylsiloxy)silane, Silaplane TM-0701T (manufactured by Chisso Corporation), 3-methacryloxypropyltrimethoxysilane and methyl methacrylate were changed to 0 g (0 mmol), 124.0 g (500 mmol) and 50.0 g (500 mmol), respectively. The resin 11 had a weight average molecular weight of 32000. A solution of resin 11 diluted with toluene for the nonvolatile portion to be 25 mass % had a viscosity of 8.5 $mm^2$/sec and a specific gravity of 0.89.

Synthesis Example of Tin Oxide Fine Particle

After a tin oxide fine powder with a BET surface area of 5 $m^2$/g was immersed in ethanol, surface-modifying treatment was conducted by heating it under nitrogen atmosphere and maintaining it at 250° C. for 1 hour to obtain a tin oxide fine particle 1.

Carrier Production Example

Example 1 of Carrier Production

The methacrylate copolymer (100 parts) with a weight average molecular weight of 35,000 obtained in Synthesis example 1 and 4 parts of titanium diisopropoxybis(ethyl acetoacetate), TC-750 (manufactured by Matsumoto Fine Chemical Co., Ltd.) as a catalyst were diluted with toluene to obtain a resin solution with a solid content of 10 wt %.

Using Mn-ferrite particle of 35 μm in weight average particle diameter as a core material, the above solution was coated using a flow-bed coating apparatus for the average film thickness to be 0.20 μm on the core material surface under controlling a temperature inside the flow tank at 70° C., and dried. The carrier obtained was fired at 180° C. for 2 hours in an electric furnace to obtain carrier A.

Example 2 of Carrier Production

Carrier B corresponding to Example 2 of carrier production was obtained in the same method as in Example 1 of carrier production except that the resin was replaced with the resin of Synthesis example 2.

Example 3 of Carrier Production

Carrier C corresponding to Example 3 of carrier production was obtained in the same method as in Example 1 of carrier production except that the resin was replaced with the resin of Synthesis example 3.

Example 4 of Carrier Production

Carrier D corresponding to Example 4 of carrier production was obtained in the same method as in Example 1 of carrier production except that the resin was replaced with the resin of Synthesis example 4.

Example 5 of Carrier Production

Carrier E corresponding to Example 5 of carrier production was obtained in the same method as in Example 1 of carrier production except that the resin was replaced with the resin of Synthesis example 5.

Example 6 of Carrier Production

Carrier F corresponding to Example 6 of carrier production was obtained in the same method as in Example 1 of carrier production except that the resin was replaced with the resin of Synthesis example 6.

Example 7 of Carrier Production

Carrier G corresponding to Example 7 of carrier production was obtained in the same method as in Example 1 of carrier production except that the catalyst was replaced with titanium diisopropoxybis(triethanolaminate), TC-400 (manufactured by Matsumoto Fine Chemical Co., Ltd.).

Example 8 of Carrier Production

Carrier H corresponding to Example 8 of carrier production was obtained in the same method as in Example 2 of carrier production except that the catalyst was replaced with titanium diisopropoxybis(triethanolaminate), TC-400 (manufactured by Matsumoto Fine Chemical Co., Ltd.).

Example 9 of Carrier Production

Carrier I corresponding to Example 9 of carrier production was obtained in the same method as in Example 3 of carrier production except that the catalyst was replaced with titanium diisopropoxybis(triethanolaminate), TC-400 (manufactured by Matsumoto Fine Chemical Co., Ltd.).

Example 10 of Carrier Production

Carrier J corresponding to Example 10 of carrier production was obtained in the same method as in Example 4 of carrier production except that the catalyst was replaced with titanium diisopropoxybis(triethanolaminate), TC-400 (manufactured by Matsumoto Fine Chemical Co., Ltd.).

Example 11 of Carrier Production

Carrier K corresponding to Example 11 of carrier production was obtained in the same method as in Example 5 of carrier production except that the catalyst was replaced with titanium diisopropoxybis(triethanolaminate), TC-400 (manufactured by Matsumoto Fine Chemical Co., Ltd.).

Example 12 of Carrier Production

Carrier L corresponding to Example 12 of carrier production was obtained in the same method as in Example 6 of carrier production except that the catalyst was replaced with titanium diisopropoxybis(triethanolaminate), TC-400 (manufactured by Matsumoto Fine Chemical Co., Ltd.).

Example 13 of Carrier Production

The methacrylic copolymer (100 parts) with a weight average molecular weight of 34,000 obtained in Synthesis example 6, 4 parts of titanium diisopropoxybis(ethyl acetoacetate), TC-750 (manufactured by Matsumoto Fine Chemical Co., Ltd.) as a catalyst, and 80 parts of an oxygen-deficient tin oxide-covered barium sulfate powder (manufactured by Mitsui Mining & Smelting Co., Ltd., product name: Passtran 4310) as a conductive fine particle were diluted with toluene to give a resin solution having a solid content of 10 wt %.

Using Mn-ferrite particles having a weight average particle diameter of 35 μm as a core material, the above solution was applied using a flow-bed coating apparatus for the average film thickness to be 0.20 μm on the core material surface under controlling the temperature inside the flow tank at 70° C., and dried. The carrier obtained was fired at 180° C. for 2 hours in an electric furnace to obtain carrier M.

Example 14 of Carrier Production

Carrier N corresponding to Example 12 of carrier production was obtained by the same method as in Example 6 of carrier production except that the conductive fine particle was replaced with tin oxide fine particle 1 obtained in synthesis example of tin oxide fine particle.

Comparative Example 1 of Carrier Production

Carrier O corresponding to Comparative example 1 of carrier production was obtained in the same method as in Example 1 of carrier production except that the resin was replaced with the resin 7 of Comparative synthesis example 1.

Comparative Example 2 of Carrier Production

Carrier P corresponding to Comparative example 2 of carrier production was obtained in the same method as in Example 1 of carrier production except that the resin was replaced with the resin 8 of Comparative synthesis example 2.

Comparative Example 3 of Carrier Production

The resin 9 obtained in Comparative synthesis example 3 of resin was adjusted using isophorone diisocyanate/trimethylolpropane adduct (IPDI/TMP: NCO %=6.1%) for the mole fraction of OH/NCO (OH is the one in resin of Synthesis example 10) to be 1/1, then, diluted with MEK to prepare a coating resin solution with a solid ratio of 3 weight %.

Using Mn-ferrite particle of 35 μm in weight average particle diameter as a core material, the above solution was coated using a flow-bed coating apparatus for the average film thickness to be 0.20 μm on the core material surface under controlling a temperature inside the flow tank at 70° C., and dried. The carrier obtained was fired at 180° C. for 2 hours in an electric furnace to obtain carrier Q.

Comparative Example 4 of Carrier Production

Carrier R corresponding to Comparative example 4 of carrier production was obtained in the same method as in Example 1 of carrier production except that the resin was replaced with the resin 10 of Comparative synthesis example 4.

Comparative Example 5 of Carrier Production

Carrier S corresponding to Comparative example 5 of carrier production was obtained in the same method as in Example 1 of carrier production except that the resin was replaced with the resin 11 of Comparative synthesis example 5.

Comparative Example 6 of Carrier Production

Carrier T corresponding to Comparative example 6 of carrier production was obtained in the same method as in Example 1 of carrier production except that 30 parts of methylsilicone resin (solid content 25%) with a weight average molecular weight of 15,000 produced from difunctional and trifunctional monomers was added.

[Evaluation of Carrier Characteristic]

Hereinafter, evaluation methods of carrier characteristics are shown.

[Weight Average Particle Diameter of Particulate Core Material]

The particle size distribution of particulate core material was measured using a micro-track particle size distribution tester, model HRA9320-X100 (manufactured by Nikkiso Co., Ltd.).

[Magnetization at Magnetic Field of 1 kOe]

After about 0.15 g of carrier was filled in a cell of 2.4 mm in inner diameter and 8.5 mm in height, magnetization was measured at a magnetic field of 1 kOe using VSM-P7-15 (manufactured by Toei Industry Co., Ltd.).

[Volume Resistivity]

Volume resistivity was measured using a cell shown in FIG. 1. Specifically, first, in a cell composed of a fluorine resin container (2) where an electrode (1*a*) and electrode (1*b*) of surface area 2.5 cm×4 cm were accommodated at a distance of 0.2 cm, a carrier (3) was filled, and tapped 10 times at a tapping speed of 30 times/min from a dropping height of 1 cm. Next, direct voltage of 1000 V was applied between the electrodes (1*a*) and (1*b*), and resistance r [Ω] after 30 seconds was measured by using a High-resistance meter 4329A (manufactured by Yokogawa Hewlett-Packard Co., Ltd.), and volume resistivity [Ω·cm] was calculated from the following [Mathematical formula 1].

$$r\times(2.5\times4)/0.2 \qquad \text{[Mathematical formula 1]}$$

[Average Film Thickness of Coating Layer]

The cross-section of carrier was observed using a transmission electron microscope (TEM) to measure the average film thickness of coating layer. The characteristics of carrier obtained are shown in Table 1.

TABLE 1

| Resin synthesis example | Carrier production example | Name of carrier | Weight average diameter (μm) | Magnetization (emu/g) | Volume resistivity (LogR (Ωcm)) | Film thickness of carrier (μm) |
|---|---|---|---|---|---|---|
| Resin synthesis Example 1 | Carrier production Example 1 | Carrier A | 36.0 | 62 | 15.5 | 0.20 |
| Resin synthesis Example 2 | Carrier production Example 2 | Carrier B | 36.1 | 62 | 15.6 | 0.20 |
| Resin synthesis Example 3 | Carrier production Example 3 | Carrier C | 36.3 | 62 | 15.7 | 0.21 |
| Resin synthesis Example 4 | Carrier production Example 4 | Carrier D | 35.7 | 62 | 15.4 | 0.20 |
| Resin synthesis Example 5 | Carrier production Example 5 | Carrier E | 36.6 | 62 | 15.6 | 0.20 |
| Resin synthesis Example 6 | Carrier production Example 6 | Carrier F | 36.5 | 62 | 15.5 | 0.21 |
| Resin synthesis Example 7 | Carrier production Example 7 | Carrier G | 36.1 | 62 | 15.6 | 0.20 |
| Resin synthesis Example 8 | Carrier production Example 8 | Carrier H | 36.0 | 62 | 15.5 | 0.20 |
| Resin synthesis Example 9 | Carrier production Example 9 | Carrier I | 36.2 | 62 | 15.7 | 0.20 |
| Resin synthesis Example 10 | Carrier production Example 10 | Carrier J | 35.9 | 62 | 15.4 | 0.20 |
| Resin synthesis Example 11 | Carrier production Example 11 | Carrier K | 36.7 | 62 | 15.6 | 0.21 |
| Resin synthesis Example 12 | Carrier production Example 12 | Carrier L | 36.3 | 62 | 15.4 | 0.20 |
| Resin synthesis Example 6 | Carrier production Example 13 | Carrier M | 35.9 | 69 | 12.8 | 0.20 |
| Resin synthesis Example 6 | Carrier production Example 14 | Carrier N | 36.5 | 67 | 13.8 | 0.21 |
| Resin synthesis Comparative example 1 | Carrier production Comparative example 1 | Carrier O | 36.4 | 62 | 15.7 | 0.21 |
| Resin synthesis Comparative example 2 | Carrier production Comparative example 2 | Carrier P | 35.6 | 62 | 15.4 | 0.20 |
| Resin synthesis Comparative example 3 | Carrier production Comparative example 3 | Carrier Q | 36.5 | 62 | 15.7 | 0.20 |
| Resin synthesis Comparative example 4 | Carrier production Comparative example 4 | Carrier R | 35.5 | 62 | 15.6 | 0.21 |
| Resin synthesis Comparative example 5 | Carrier production Comparative example 5 | Carrier S | 36.6 | 62 | 15.4 | 0.20 |
| — | Carrier production Comparative example 6 | Carrier T | 35.7 | 62 | 15.4 | 0.20 |

[Measurement of Ba/Si]

The ratio of Ba and Si contents of carrier M, Ba/Si, was measured using an X-ray photoelectron spectrometer (XPS). The detail is described below.

Measuring apparatus: AXIS-ULTRA manufactured by Kratos

| | | |
|---|---|---|
| Light source for measurement: | | Al (monochrome meter) |
| Power for measurement: | | 90 W (15 kV, 6 mA) |
| Field of measurement: | | 900 × 600 ($\mu m^2$) |
| Pass energy: | (wide scan) | 160 eV, |
| | (narrow scan) | 40 eV |
| Energy step: | (wide scan) | 1.0 eV, |
| | (narrow scan) | 0.2 eV |

Relative sensitivity coefficient: Kratos' relative sensitivity coefficient was used Because it is a magnetic material, the measurement was conducted in a condition where MAGNET CONTROLLER is OFF.

For the above-described measurement, a sample was put in a chip with a cylindrical hole of 0.3 mm in depth, and the flat part of the surface was measured. The measurement result is expressed in terms of atomic % (number), and the Ba/Si ratio was calculated using the ratio of the measured values. The Ba/Si ratio of carrier M was 0.077.

Toner Production Example

Synthesis Example of Polyester Resin A

In a reactor equipped with a thermometer, stirrer, condenser and nitrogen-introducing tube, 443 parts of PO adduct of bisphenol-A (hydroxyl value 320), 135 parts of diethylene glycol, 422 parts of terephthalic acid and 2.5 parts of dibutyltin oxide were put, and reacted at 200° C. till the acid value became 10, obtaining a "polyester resin A." Tg of the resin was 63° C. and the peak number average molecular weight was 6000.

Synthesis Example of Polyester Resin B

In a reactor equipped with a thermometer, stirrer, condenser and nitrogen-introducing tube, 443 parts of PO adduct of bisphenol-A (hydroxyl value 320), 135 parts of diethylene glycol, 422 parts of terephthalic acid and 2.5 parts of dibutyltin oxide were put, and reacted at 230° C. till the acid value became 7, obtaining a "polyester resin B." Tg of the resin was 65° C. and the peak number average molecular weight was 16000.

Polyester resin A . . . 40 parts
Polyester resin B . . . 60 parts
Carnauba wax . . . 1 part
Carbon black (#4, manufactured by Mitsubishi Chemical Corp.) . . . 10 parts The above-described toner components were mixed by a Henschel mixer (Henschel 20B manufactured by Mitsui Mining Co., Ltd, 1500 rpm for 3 minutes), and kneaded by a uniaxial kneader (small size Buss co-kneader manufactured by Buss Corporation) in the following condition (preset temperature: inlet zone 100° C., outlet zone 50° C., feed rate: 2 kg/Hr), obtaining a "parent toner A1."

Further, after the "parent toner A1" was kneaded, it was extended and cooled, crashed by Pulverizer, and further finely crushed by I-system mill (IDS-2 type manufactured by Nippon Pneumatic Co., Ltd., using a planer collision plate, under the condition of air pressure: 6.8 atm/$cm^2$, feed rate: 0.5 kg/hr), further, classified (132MP manufactured by Alpine Corporation), thereby to obtain a "parent toner particle 1."

(External Additive Treatment)

To the "parent toner particle 1", 1.0 parts of hydrophobic silica fine polder (R972: manufactured by Nippon Aerosil Co., Ltd.) was added as an external additive, and mixed by a Henschel mixer to obtain a toner particle (hereinafter referred to "toner 1").

[Production of Developer]

Hereinafter, by means of Examples and Comparative examples, the present invention is further specifically explained, but the present invention is not limited thereto. Additionally, "part" represents part by weight.

To the carriers A to R (93 parts) obtained in Carrier production example, 7.0 parts of toner 1 (7.2 μm) obtained in Toner production example was added, and stirred by a ball mill for 20 minutes to produce developers A to R.

[Evaluation of Developer Characteristic]

Using the developer obtained, image evaluation was carried out by a digital full-color complex machine, Imagio Neo C600 (manufactured by Ricoh Co., Ltd.). Specifically, First, Using the developers A to H of Examples and Comparative examples and toner 1 of Example, the charging amount and volume resistivity of carrier were measured at an early stage and after run of 100,000 copies by image area ratio of 20%, and the lowering rate of the charging amount and the change rate of volume resistivity were calculated.

Additionally, the charging amount of carrier at an early stage (Q1) was measured by a sample where carrier A to T and toner 1 of Example were mixed by a mass ratio of 93:7 followed by friction electrification, using a blow-off apparatus, TB-200 (manufactured by Toshiba Chemical corporation). The charging amount of carrier after the run (Q2) was measured using the blow-off apparatus in the same way as the above except for using a carrier that a toner of each color in the developer after the run was removed. Additionally, a target value of change rate of the charging amount is not more than 10 μC/g.

On the other hand, volume resistivity (Log R1) of carrier at an early stage is the common logarithm of volume resistivity of carrier measured in the same way as the above-described "volume resistivity." Volume resistivity (Log R2) of carrier after the run was measured using the blow-off apparatus in the same way as the above except for using a carrier that a toner of each color in the developer after the run was removed. Additionally, a target value of volume resistivity is not more than 1.5 Log (Ω·cm) in absolute value. The evaluation result of developer is shown in Table 2.

TABLE 2

| Carrier production example | Name of carrier | Name of developer | Q1 (−μC/g) | Q2 (−μC/g) | Q1-Q2 (μC/g) | LogRl (Ωcm) | LogR2 (Ωcm) | LogR1-LogR2 (Ωcm) |
|---|---|---|---|---|---|---|---|---|
| Carrier production Example 1 | Carrier A | Developer A | 37 | 35 | 2 | 15.5 | 15.2 | 0.3 |

TABLE 2-continued

| Carrier production example | Name of carrier | Name of developer | Q1 (−μC/g) | Q2 (−μC/g) | Q1-Q2 (μC/g) | LogR1 (Ωcm) | LogR2 (Ωcm) | LogR1-LogR2 (Ωcm) |
|---|---|---|---|---|---|---|---|---|
| Carrier production Example 2 | Carrier B | Developer B | 40 | 37 | 3 | 15.6 | 15.2 | 0.4 |
| Carrier production Example 3 | Carrier C | Developer C | 44 | 37 | 7 | 15.7 | 15.1 | 0.6 |
| Carrier production Example 4 | Carrier D | Developer D | 35 | 30 | 5 | 15.4 | 15.9 | −0.5 |
| Carrier production Example 5 | Carrier E | Developer E | 41 | 36 | 5 | 15.6 | 15.1 | 0.5 |
| Carrier production Example 6 | Carrier F | Developer F | 38 | 35 | 3 | 15.5 | 15.2 | 0.3 |
| Carrier production Example 7 | Carrier G | Developer G | 36 | 33 | 3 | 15.6 | 15.2 | 0.4 |
| Carrier production Example 8 | Carrier H | Developer H | 38 | 36 | 2 | 15.5 | 15.0 | 0.5 |
| Carrier production Example 9 | Carrier I | Developer I | 42 | 35 | 7 | 15.7 | 15.2 | 0.5 |
| Carrier production Example 10 | Carrier J | Developer J | 34 | 29 | 5 | 15.4 | 15.7 | −0.3 |
| Carrier production Example 11 | Carrier K | Developer K | 39 | 35 | 4 | 15.6 | 15.3 | 0.3 |
| Carrier production Example 12 | Carrier L | Developer L | 36 | 32 | 4 | 15.4 | 15.2 | 0.2 |
| Carrier production Example 13 | Carrier M | Developer M | 38 | 31 | 7 | 12.8 | 12.1 | 0.7 |
| Carrier production Example 14 | Carrier N | Developer N | 40 | 34 | 6 | 13.8 | 13.2 | 0.6 |
| Carrier production Comparative example 1 | Carrier O | Developer O | 47 | 34 | 13 | 15.7 | 14.3 | 1.4 |
| Carrier production Comparative example 2 | Carrier P | Developer P | 36 | 25 | 13 | 15.4 | 16.1 | −0.7 |
| Carrier production Comparative example 3 | Carrier Q | Developer Q | 46 | 32 | 14 | 15.7 | 14.1 | 1.6 |
| Carrier production Comparative example 4 | Carrier R | Developer R | 39 | 24 | 15 | 15.6 | 16.0 | −0.4 |
| Carrier production Comparative example 5 | Carrier S | Developer S | 37 | 20 | 17 | 15.4 | 16.3 | −0.9 |
| Carrier production Comparative example 6 | Carrier T | Developer T | 33 | 45 | -12 | 15.4 | 14.8 | 0.6 |

This application claims priority and contains subject matter related to Japanese Patent Applications Nos. 2009-236349, 2010-174106, 2009-238554, 2009-286748 and 2010-199278, filed on Oct. 13, 2009, Aug. 3, 2010, Oct. 15, 2009, Dec. 17, 2009 and Sep. 6, 2010 respectively, the entire contents of each of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A carrier, comprising:

a magnetic particulate core material; and a resin layer overlying the magnetic particulate core material, wherein the resin layer comprises a resin obtained by heat treatment of a copolymer comprising a site derived from a monomer component having the following formula (1) and a site derived from a monomer component having the following formula (2), and wherein the resin layer comprises a cross-linked material obtained by hydrolysis of the copolymer to produce a silanol group and condensation using an organotitanium compound:

(1)

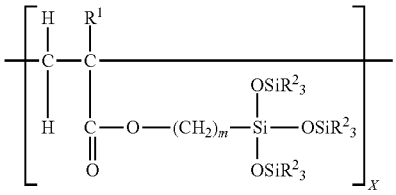

(2)

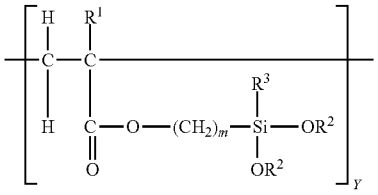

wherein $R^1$ represents a hydrogen atom or a methyl group; m is an integer of 1 to 8; $R^2$ represents an alkyl group having 1 to 4 carbon atoms; $R^3$ represents an alkyl group having 1 to 8 carbon atoms or an alkoxy group having 1 to 4 carbon atoms; X represents 10 to 90 mol %; and Y represents 10 to 90 mol %.

2. The carrier of claim 1, wherein the copolymer comprises a copolymer having the following formula (5):

(5)

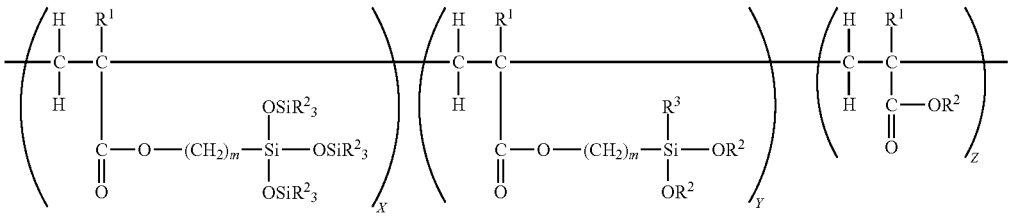

wherein $R^1$ represents a hydrogen atom or a methyl group; m is an integer of 1 to 8 ; $R^2$ represents an alkyl group having 1 to 4 carbon atoms; $R^3$ represents an alkyl group having 1 to 8 carbon atoms or an alkoxy group having 1 to 4 carbon atoms; X represents 10 to 40 mol %; Y represents 10 to 40 mol %; Z represents 30 to 80 mol %; and Y+Z is greater than 60 mol % and less than 90 mol %.

3. The carrier of claim 1, wherein the organotitanium compound is titanium alkoxide.

4. The carrier of claim 1, wherein the organotitanium compound is titanium chelate.

5. The carrier of claim 1, wherein the carrier is obtained by a method comprising:

coating the particulate core material with the resin layer to prepare a resin-coated particulate core material; and subjecting the resin-coated particulate core material to the heat treatment.

6. The carrier of claim 1, wherein the heat treatment is performed at a temperature of from 100 to 350° C.

7. The carrier of claim 1, wherein the resin layer further comprises an electroconductive particulate material.

8. The carrier of claim 7, wherein the electroconductive particulate material comprises barium sulfate.

9. The carrier of claim 8, wherein a ratio (Ba/Si) of Ba to Si as measured by an X-ray photoelectron spectroscopy (XPS) is from 0.01 to 0.08.

10. The carrier of claim 7, wherein the electroconductive particulate material is a particulate tin oxide having a carbon atom in its surface.

11. The carrier of claim 1, wherein the carrier has a volume resistivity of from $1\times10^9$ to $1\times10^{17}$ Ω·cm.

12. The carrier of claim 1, wherein the resin layer has an average thickness of from 0.05 to 4 μm.

13. The carrier of claim 1, wherein the particulate core material has a weight-average particle diameter of from 20 to 65 μm.

14. The carrier of claim 1, wherein the carrier has a magnetization of from 40 $Am^2$/kg to 90 $Am^2$/kg in a magnetic field of 1 kOe.

15. A developer, comprising:

the carrier according to claim 1; and a toner.

16. The developer of claim 15, wherein the toner is a color toner.

17. A method of preparing a carrier comprising a particulate core material and coated layer, comprising:

subjecting a copolymer including a site derived from a monomer component having the following formula (1) and a site derived from a monomer component having the following formula (2) to hydrolysis to produce a silanol group, and condensing the copolymer to produce a cross-linked material with an organotitanium compound:

(1)

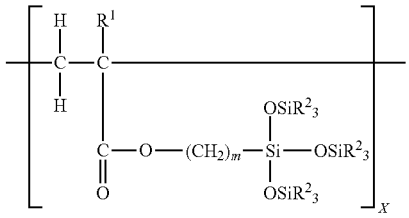

-continued (2)

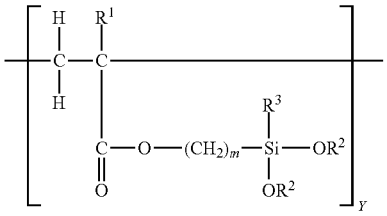

wherein $R^1$ represents a hydrogen atom or a methyl group; m is an integer of 1 to 8 ; $R^2$ represents an alkyl group having 1 to 4 carbon atoms; $R^3$ represents an alkyl group having 1 to 8 carbon atoms or an alkoxy group having 1 to 4 carbon atoms; X represents 10 to 90 mol %; and Y represents 10 to 90 mol %.

18. An image forming method comprising:

forming an electrostatic latent image on an image bearing member;

developing the electrostatic latent image with the developer according to claim 15 to form a toner image on the image bearing member;

transferring the toner image to a recording material; and fixing the toner image to the recording material.

* * * * *